US008313151B2

(12) United States Patent
Junker

(10) Patent No.: US 8,313,151 B2
(45) Date of Patent: Nov. 20, 2012

(54) METHOD OF CONTROLLING THE CONVEYANCE OF PRODUCT IN UNDERGROUND MINING OPERATIONS

(75) Inventor: Martin Junker, Rheinberg (DE)

(73) Assignee: RAG Aktiengesselschaft (DE)

( * ) Notice: Subject to any disclaimer, the term of this patent is extended or adjusted under 35 U.S.C. 154(b) by 428 days.

(21) Appl. No.: 12/523,794

(22) PCT Filed: Jan. 9, 2008

(86) PCT No.: PCT/EP2008/000110

§ 371 (c)(1),
(2), (4) Date: Jul. 20, 2009

(87) PCT Pub. No.: WO2008/086966

PCT Pub. Date: Jul. 24, 2008

(65) Prior Publication Data

US 2010/0096904 A1 Apr. 22, 2010

(30) Foreign Application Priority Data

Jan. 20, 2007 (DE) ..... 10 2007 003 020

(51) Int. Cl.
*E21F 13/04* (2006.01)

(52) U.S. Cl. ..... 299/1.9

(58) Field of Classification Search ..... 299/1.9, 299/18; 198/502.1; 700/230
See application file for complete search history.

(56) References Cited

U.S. PATENT DOCUMENTS

| | | | | |
|---|---|---|---|---|
| 4,015,124 | A * | 3/1977 | Page | 378/45 |
| 4,212,382 | A * | 7/1980 | Williams | 198/502.2 |
| 4,952,000 | A * | 8/1990 | Lipinski et al. | 299/1.6 |
| 5,709,433 | A * | 1/1998 | Christopher et al. | 299/30 |

FOREIGN PATENT DOCUMENTS

| | | |
|---|---|---|
| DE | 11 83 875 | 11/1959 |
| DE | 3823863 | 12/1989 |
| DE | 102004059071 | 6/2006 |
| DE | 102005038366 | 12/2006 |
| GB | 2093123 | 2/1982 |
| WO | WO 87/04224 | 7/1987 |

OTHER PUBLICATIONS

Alina Fraczyk Measuring and Monitoring Relays ABB STOTZ-KONTACK GmbH Publication No. 2CDC112 004 M0201, Feb 2004.*

* cited by examiner

*Primary Examiner* — John Kreck
(74) *Attorney, Agent, or Firm* — Robert Becker; Becker & Stachniak, P.C.

(57) ABSTRACT

A method of controlling conveyance of the debris, extracted by working machines in underground mining operations, via conveyors and bunker units. The lowest available conveying capacity of the conveyors and buffer capacity of the bunker units are determined based on continuously detected actual data and are compared in a computer-aided control unit to at least one of current actual extraction output, anticipated target extraction output, and scheduled output extrapolated from past actual data. Upon detection of deviations, the control unit automatically effects a balancing of capacities between the conveyors and bunker units connected at an output side of each individual different working machine, taking into consideration their maximum conveying capacity and buffer capacity respectively, and/or controls the extraction output of the working machines taking into consideration respectively available conveying capacity of downstream conveyors and buffer capacity of the bunker units.

10 Claims, No Drawings

METHOD OF CONTROLLING THE CONVEYANCE OF PRODUCT IN UNDERGROUND MINING OPERATIONS

BACKGROUND OF THE INVENTION

The instant application should be granted the priority dates of Jan. 20, 2007, the filing date of the corresponding German patent application DE 10 2007 003 020.9, as well as Jan. 9, 2008, the filing date of the International patent application PCT/EP2008/000110.

The present invention relates to a method of controlling the removal or conveyance of the debris, extracted by mining or working machines in underground mining operations at various locations of the mine structure, via conveying means and bin or bunker units disposed in the mine structure to the mine shaft, which is equipped with a conveying device, or to a raw coal transfer location at the surface, for example to a raw coal deposit.

In conformity with the conventional manner of proceeding, and thus forming the state of the art, the design, as well as the operational control, of the conveying means and bunker units that are connected at an output side of the individual working machines that are utilized at various sites of the mine structure, are effected in a projected manner according to the performance characteristics of the pertaining operating means and the theoretical yield of the debris respectively extracted by the working machines. In underground coal mining operations, to which reference is subsequently made by way of example, such working machines are mining machines placed in longwalls, or cutting or driving machines placed in roadway drivages. In this connection, the storage units, which are disposed between individual conveying means, especially chain conveyors or belt units, based on their buffer capacity are to provide an evening out of the delivery rates, and to compensate for brief conveying spikes.

Under today's operating conditions, the preceding limitations cannot satisfy the requirement for a maximum utilization of the fixed conveying capacity of a mine shaft, since the dynamic nature of every mine, with a change in location of the working and cutting operations, a constant change in length of the conveying means, as well as a discontinuous provision of raw material products, namely coal, with regard to the quantity as well as the quality, requires a constant adaptation of the interaction of the various operating means of a conveying chain to the changing operating conditions. Thus, for example, generally brief, technically readily possible increases of the extraction capacity of working machines cannot be realized unless simultaneously the smooth-running removal of the debris to the mine shaft is ensured. In this connection, one must realize that the conveyance stream coming from one mining operation is combined with conveyance streams from other mining operations, so that depending upon the debris yield in the mining operations, these conveyance streams can affect one another, with appropriate restrictions.

It is therefore an object of the present invention to provide a method of the aforementioned type by means of which it is possible to realize a maximum and as constant as possible of a product provision at the mine shaft conveying means of a mining operation.

SUMMARY OF THE INVENTION

The basic concept of the present invention is a method that for the conveying means and bunker units that are connected at an output side of each individual working machine, respectively determines the least available conveying capacity of the conveying means and buffer capacity of the bunker units based on continuously detected actual data, and, in a computer-aided control unit, compares these capacities to the current actual extraction output and/or to the target extraction output anticipated for a prescribed period of time and/or to the scheduled output of the associated working machine extrapolated from past actual data, and whereby upon detection of deviations, the control unit accomplishes automatically effecting a balance of capacities between the conveying means and bunker units that are connected at an output side of the individual different working machines by appropriately controlling the individual conveying means and bunker units, while taking into consideration their maximum conveying capacity and buffer capacity respectively, and/or controlling the extraction output of the working machines while taking into consideration the respectively available conveying capacity of the downstream conveying means and the buffer capacity of the bunker units.

Thus, the control method provides no alteration or adaptation as long as the capacity of the downstream conveying means and bunker units, taking into consideration further debris quantities supplied from other mining operations, are equal to the actual or, for a fixed forecast period of time, planned extraction output of a single working machine. However, if a deviation is determined in the control unit such that a capacity bottleneck is recognizable in the removal conveyance, there is automatically effected by the control unit a balancing of capacities between the various conveying means and bunker units that are connected at an output side of the various working operations, while taking into consideration the actual state provided at this working machine or the target state planned in the contemplated forecast time period, so that an optimum conveyance quantity can be achieved taking into account all of the individual conveyance streams.

With the present invention, it is advantageously possible, by anticipated forecast of the process, to recognize prepared bottlenecks in the conveyance paths, not only on the extraction side but also on the conveyance side, and to counteract this in an early manner and hence to avoid stoppage in the extraction and forward output by suitable measures that are adapted to the overall system of a mining operation. Since in an operational setting not always all of the working or mining operations aligned in a mine structure can and will run at the same time, the extraction readiness of the working operation should be determined for a specific, prescribed forecast period of time, and thereupon all capacities of the conveying means, including the necessary buffer capacities, are controlled in such a way that an optimum quantity of conveyed material can be removed. The individual conveying means can be controlled from the mine shaft back to the extraction means in such a way that they are constantly upgraded at an output limit that is to be determined and thus "quasi" produce an undertow or suction. In this connection, if sufficient material to be conveyed is made available, the actual conveyance of the leading conveying means can be increased until the following conveying means reaches its capacity limit. To this extent, the control system recognizes and avoids the critical limiting location in the removal conveyance, the so-called bottleneck.

A further advantage is that the inventive method makes it possible to have a projected influence upon the quality of the conveyed coal by altering and adapting the extraction output of the individual working operations as a function of the raw material properties, such as sulfur, chlorine and/or ash content, of the coal existing in the various working operations, whereby at the same time and automatically there is also ensured, by the adaptation of the capacities of the downstream conveying means and bunker units, that the prescribed quantities and qualities are made available for conveyance within the prescribed time frame at the mine shaft.

Pursuant to one embodiment of the invention, as actual data the speeds of the conveying means are detected for the current conveying capacity of the conveying means, and the bunker withdrawal rates are detected for the current buffer capacity of the bunker units. Pursuant to an advantageous embodiment, the maximum conveying capacity of the conveying means is determined based on output data of the drive motors and/or of threshold values for engine currents and/or threshold values for engine temperatures.

Pursuant to one embodiment of the invention, for adaptation to the buffer capacity of a conveying means that is to be kept available, a variable adjustment of its speed is provided.

Pursuant to one embodiment of the invention, the target extraction output, relative to the prescribed period of time, and/or the extraction output extrapolated from past actual data, is determined on the basis of the seam or deposit thickness as well as the advancement speed of the working machines, whereby pursuant to a further alternative embodiment, also the manning of the respective mining or working operation, and/or the maintenance data, such as maintenance intervals and inspection data, are taken into consideration.

Furthermore, the methane content and/or the CO content can be included in the determination of the target extraction output.

The actual data collected from the processes working and conveyance are to a certain extent logically linked or correlated with one another in the control unit, whereby the control unit, as a reaction thereto, by means of suitable computing programs controls the downstream operating means and/or the extraction machines in conformity therewith, or makes their free capacity evident.

Pursuant to one embodiment of the invention, the control unit effects an increase of the extraction output based on the respectively free, not yet utilized conveying capacity of the downstream conveying means.

Furthermore, the actual data, the target data as well as the control processes effected by the control unit can be visualized.

DESCRIPTION OF SPECIFIC EMBODIMENTS

One example of such a method is the planning or design forecast for a mining or working operation having a temporary change in priorities.

An extraction operation "A" is provided with two shifts; the target conveyance is 4,200 t/d. By determining the actual data, it is recognized that the aforementioned target conveyance of the pertaining extraction operation "A" is compromised because the capacity of the downstream conveying means and bunker units at the time of the interrogation or inquiry will not suffice to the end of the second shift in order to realize a target conveyance at the magnitude of EUR 4,200 t/d.

To achieve this conveyance target for the extraction operation "A", the control unit, in the framework of an automatic chance and risk evaluation, checks to see whether a greater conveyance or removal capacity can temporarily be made available to the extraction operation "A" without having extraction operations "B" and/or "C", which are also operating, missing their daily target if the removal capacity assigned to them is possibly temporarily reduced, so that as a consequence overall the best possible conveying quantity can be achieved for the extraction operations "A", "B", and "C".

The features of the subject matter of these documents disclosed in the preceding description and the claims can be important individually as well as in any desired combination with one another for realizing the various embodiments of the invention.

The specification incorporates by reference the disclosure of German 10 2007 003 020.9 filed Jan. 20, 2007, as well as International application PCT/EP2008/000110, filed Jan. 9, 2008.

The present invention is. of course, in no way restricted to the specific disclosure of the specification and drawings, but also encompasses any modifications within the scope of the appended claims.

The invention claimed is:

1. A method of controlling removal or conveyance of debris, extracted by working machines in underground mining operations at various locations of a mine structure, via conveying means and bunker units disposed in the mine structure to a central location, said method including the steps of:

for said conveying means and bunker units that are connected at an output side of each individual working machine, respectively determining a conveying capacity of each of said conveying means and buffer capacity of said bunker units based on continuously detected actual data and from the conveying capacities and buffer capacities that are determined, then determining a lowest conveying capacity of the conveying means and buffer capacity of said bunker units;

comparing said lowest conveying capacity and said buffer capacity, in a computer-aided control unit, to at least one of:

a) the current actual extraction output, b) the target extraction output anticipated for a prescribed period of time, and c) the scheduled output of an associated working machine extrapolated from past actual data, and upon detection of a deviation between said lowest conveying capacity and said buffer capacity and at least one of said current actual extraction output, said target extraction output, and said scheduled output, said control unit performs at least one of:

1) automatically effecting a balancing of capacities between said conveying means and bunker units that are connected to output sides of the working machines by appropriately controlling the conveying means and bunker units not having the lowest conveying capacity and buffer capacity, while taking into consideration a maximum conveying capacity and buffer capacity respectively of each said conveying means and bunker units not having the lowest conveying capacity and buffer capacity, and 2) controlling the extraction output of said working machines while taking into consideration the respectively available conveying capacity of downstream conveying means and the buffer capacity of the bunker units.

2. A method according to claim 1, wherein as actual data, the speeds of the conveying means are detected for the current conveying capacity of the conveying means, and the bunker withdrawal rates are detected for the current buffer capacities of the bunker units.

3. A method according to claim 2, wherein the maximum conveying capacity of the conveying means is determined on the basis of at least one of output data of drive motors, threshold values for motor currents, and threshold values for motor temperatures.

4. A method according to claim 2, wherein a buffer capacity of the conveying means that are used can be adapted by means of an alteration of the speed of the conveying means.

5. A method according to claim 1, wherein said target extraction output of a working machine, relative to said prescribed period of time, is determined on the basis of an extraction cross-section, which forms a function of a deposit thickness, and of an advancement speed of said working machine.

6. A method according to claim 1, wherein at least one of said target extraction output, relative to said prescribed period of time, and said extraction output extrapolated from determined actual data, of each individual extraction operation, is determined taking into consideration at least one of manning of said extraction operation, and maintenance data such as maintenance intervals and inspection data.

7. A method according to claim 1, which includes the further step of determining said target extraction output of each individual extraction operation taking into consideration quality features of coal that is to be mined, such as at least one of sulfur, chlorine and ash content.

8. A method according to claim 1, which includes the further step of including at least one of methane content and CO content in a determination of said target extraction output.

9. A method according to claim 1, wherein said control unit effects an increase of said extraction output based on a free, not yet utilized conveying capacity of a downstream conveying means.

10. A method according to claim 1, which includes the further step of visualizing actual data, target data, and control processes effected by said control unit.

* * * * *